US007696446B2

(12) United States Patent
Yeh et al.

(10) Patent No.: US 7,696,446 B2
(45) Date of Patent: Apr. 13, 2010

(54) KEY STRUCTURE

(75) Inventors: Liang-Ta Yeh, Taipei County (TW); Chih-Chung Yen, Taoyuan County (TW)

(73) Assignee: Darfon Electronics Corp., Taoyuan (TW)

( * ) Notice: Subject to any disclaimer, the term of this patent is extended or adjusted under 35 U.S.C. 154(b) by 0 days.

(21) Appl. No.: 12/349,210

(22) Filed: Jan. 6, 2009

(65) Prior Publication Data

US 2009/0178910 A1 Jul. 16, 2009

(30) Foreign Application Priority Data

Jan. 11, 2008 (TW) ..... 97200678 U

(51) Int. Cl.
*H01H 13/70* (2006.01)

(52) U.S. Cl. ..... 200/344

(58) Field of Classification Search ..... 200/344; 400/490–496

See application file for complete search history.

(56) References Cited

U.S. PATENT DOCUMENTS 5,770,824 A * 6/1998 Tsai et al. ..... 200/5 A
6,448,520 B1 * 9/2002 Inoue ..... 200/344
6,958,458 B1 * 10/2005 Tsai ..... 200/344
7,138,587 B2 * 11/2006 Nishino et al. ..... 200/5 A

* cited by examiner

*Primary Examiner*—Michael A Friedhofer
(74) *Attorney, Agent, or Firm*—Morris, Manning & Martin LLP; Tim Tingkang Xia

(57) ABSTRACT

The invention discloses a key structure comprising a keycap, a base plate, and a support member. The keycap comprises a slide part; the base plate comprises an engagement part; the support member comprises a slide end and an engagement end, and the support member is used for engaging the keycap and the base plate. The slide end slides along the slide part, and the engagement end is engaged to the engagement part. Therein, the slide end comprises a connection part, and the connection part comprises at least one concave part or at least one hole.

14 Claims, 4 Drawing Sheets

KEY STRUCTURE

CROSS-REFERENCE TO RELATED APPLICATIONS

This non-provisional application claims priority under 35 U.S.C. §119(a) on Patent Application No. 097200678 filed in Taiwan R.O.C. on Jan. 11, 2008, the entire contents of which are hereby incorporated by reference.

BACKGROUND OF THE INVENTION

1. Field of the Invention

The present invention relates to a key structure, and more particularly relates to a key structure with a larger deformation limit.

2. Description of the Prior Art

In more developed countries, especially those which are information-rich, almost every family has at least one computer. Computers are used to help people get information from the Internet, or communicate with others by means of messenger software. The most common input device of a computer is a keyboard. The elementary component of a keyboard is a key. Please refer to FIG. 1. FIG. 1 is a cross-sectional view of a key structure 1 in the prior art. As illustrated in FIG. 1, the key structure 1 includes a key a keycap 10, a support member 12 and a base plate 14. The keycap 10 can move perpendicularly relative to the base plate 14 by means of the support member 12. When the keycap 10 needs to be separated from the support member 12, owing to the keycap 10 is commonly engaged with the support member 12 by a tenon, the support member 12 is easily damaged if the removing force or the direction of removing the keycap 10 is inappropriate.

Accordingly, the main aspect of the present invention is to provide a key structure with a larger deformation limit to solve the problems mentioned above.

SUMMARY OF THE INVENTION

An aspect of the present invention is to provide a key structure with a concave part to increase the deformation limit and the flexibility.

According to a preferred embodiment, the key structure of the invention comprises a keycap, a base plate, and a support member. The keycap comprises a first engagement part and a first slide part; the base plate comprises a second engagement part and a second slide part; and the support member engages with the keycap and the base plate, the support member comprises a first brace and a second brace. The first brace crisscrosses and engages with the second brace, the first brace comprises a first end and a second end, the second brace comprises a third end and a fourth end. The first end engages with the first engagement part, and the second end slides along the second slide part. The third end slides along the first slide part, and the fourth end engages with the second engagement part. Wherein the third end comprises a connection part, and the connection part comprises at least one concave part or at least one hole.

Thereby, the concave part of the connection part increases the deformation limit of the connection part. When the keycap needs to be detached from the support member, alternatively, the third end of the second brace sustains a detaching force, and the connection part of the third end can sustain a larger deformation. The connection part will not be damaged while the keycap is detached from the support member. Thus, the durability of the key structure can be increased.

The objective of the present invention will no doubt become obvious to those of ordinary skill in the art after reading the following detailed description of the preferred embodiment, which is illustrated in the various figures and drawings.

BRIEF DESCRIPTION OF THE APPENDED DRAWINGS

DETAILED DESCRIPTION OF THE INVENTION

Figure 1:
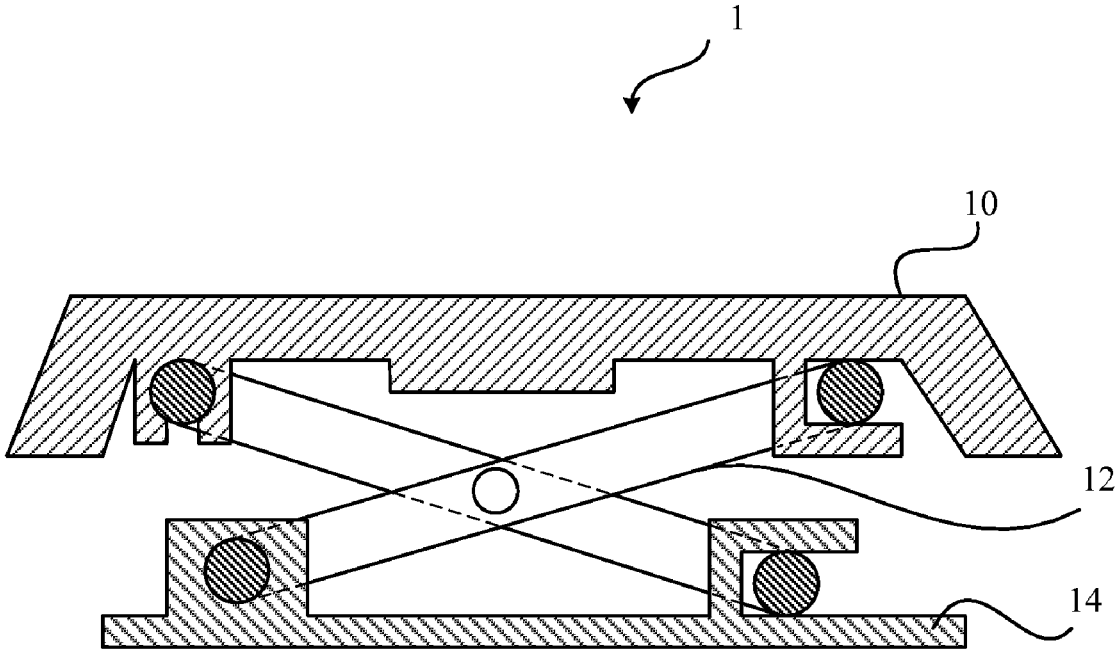
FIG. 1 (prior art)
FIG. 1 is a cross-sectional view of a key structure according to the prior art.
Figure 2:
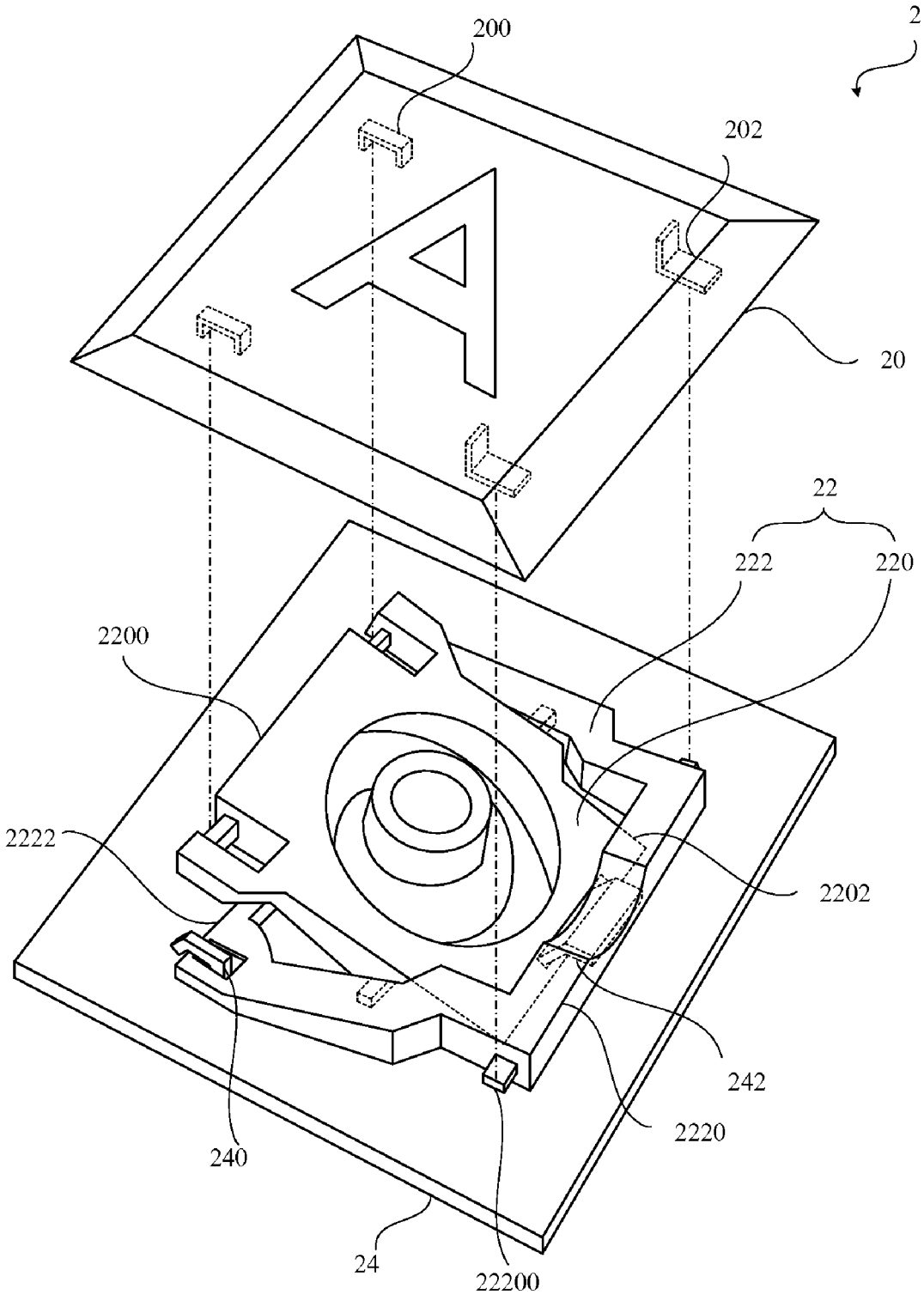
FIG. 2 illustrates a key structure according to the first embodiment of the present invention.

Please refer to FIG. 2. FIG. 2 illustrates a key structure 2 according to the first embodiment of the present invention. The key structure 2 comprises a keycap 20, a support member 22, and a base plate 24. The keycap 20 comprises a first engagement part 200 and a first slide part 202. The base plate 24 comprises a second engagement part 240 and a second slide part 242.

In the first embodiment, the support member 22 engages with the keycap 20 and the base plate 24, and the keycap 20 can move perpendicularly to the base plate 24 by means of the support 22. The support member 22 comprises a first brace 220 and a second brace 222. The first brace 220 crisscross engages with the second brace 222. As illustrated in FIG. 2, the first brace 220 and the second brace 222 are shaped approximately as a square frame. There are two protrusion pillars protruding at about the middle of the outside rim of the first brace 220, and there are two concaves formed at about the middle of the inside rim of the second brace 222. The two concaves correspondingly engage with the two protrusion pillars, so the first brace 220 crisscrosses and engages with the second brace 222. Thus, the first brace 220 and the second brace 222 are shaped like a pair of scissors that enables the keycap 20 to move perpendicularly relative to the base plate 24.

The first brace 220 comprises a first end 2200 and a second end 2202, the second brace 222 comprises a third end 2220 and a fourth end 2222. The first engagement part 200 is a U-shaped object, and the first end 2200 of the first brace 220 has a pivot. By means of the U-shaped first engagement part 200 clipping the pivot, the first end 2200 engages with the first engagement part 200. The second slide part 242 is a horizontal U-shaped object and has an L-shaped board extending from a surface of the base plate 24, and a slide space is formed between the L-shaped board and the surface. The second end 2202 has a slide chunk sliding in the slide space mentioned above. Thereby, the second end 2202 slides along the second slide part 242.

Similar to the engagement between the first end 2200 and the first engagement part 200, a hook extends from the base plate 24 as illustrated in FIG. 2, and the fourth end 2222 has a through hole and a pivot (located under the hook and is not shown in the FIG. 2). The structure of the hook matches the pivot, and a second engagement part 240 is constituted by the surface of the base plate 24 and the hook. Thereby, the hook penetrates the through hole and hooks the pivot, to accomplish the engagement between the second engagement part 240 and the fourth end 2222, thus the second brace 222 can rotate relative to the pivot.

Similar to the engagement between the second end 2202 and the second slide part 242, the first slide part 202 is also a horizontal U-shaped object and has an L-shaped board extending from a bottom surface of the keycap 20, and a slide space is formed between the L-shaped board and the bottom surface. The third end 2220 of the second brace 222 correspondingly has two protrusion parts 22200 respectively sliding in the slide spaces of the first slide part 202. Thereby, the third end 2220 slides along the first slide part 202. Moreover, the structural variations of the third end 2220 are described in the followings.

Figure 3A:
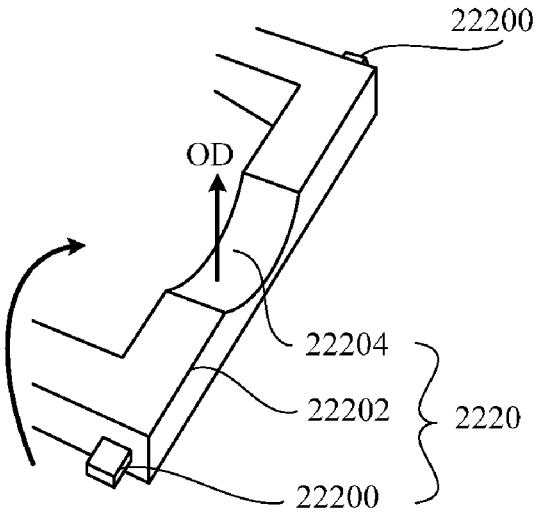
FIG. 3A illustrates a third end of a support member in FIG. 2.

Please refer to FIG. 2 and FIG. 3A. FIG. 3A illustrates the third end 2220 of the support member 22 in FIG. 2. As illustrated in FIG. 3A, the third end 2220 comprises two protrusion parts 22200 and a connection part 22202. The two protrusion parts 22200 protrude from two sides of the connection part 22202, and the connection part 22202 has a concave part 22204. The concave part 22204 thereon defines an opening direction OD, when the second brace 220 substantially lies on the base plate 24, the opening direction OD points to the keycap 20. Besides, the opening direction OD in another embodiment of the invention could point to the base plate 24.

If users want to remove the keycap 20 from the key structure 2, they can exert a force on one of the protrusion parts 22200 of the third end 2220, and the exterior force direction is shown as the curve with an arrow illustrated in FIG. 3A. Since the connection part 22202 has the concave part 22204 and is thinner, the connection part 22202 could be more flexible. Moreover, the concave space surrounded by the concave part 22204 can be the deformation space of the connection part 22202, so the concave part 22204 increases the deformation limit of the connection part 22202. Therefore, when the third end 2220 sustains an exterior force, the connection part 22202 or the protrusion parts 22200 is more difficultly damaged compared to that in the prior art.

Figure 3B:
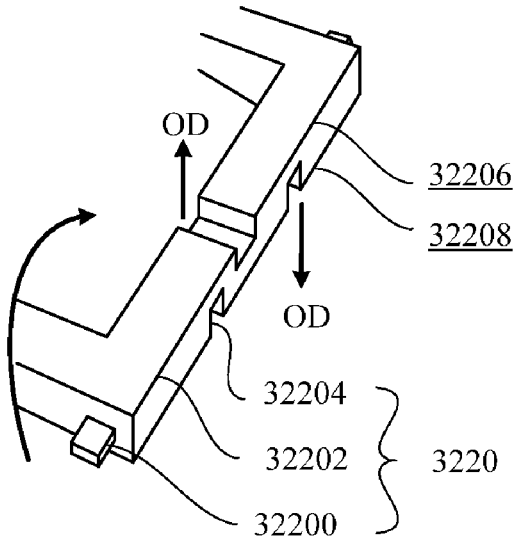
FIG. 3B illustrates a third end according to a second embodiment.

Please refer to FIG. 3B. FIG. 3B illustrates a third end 3220 according to a second embodiment. As illustrated in FIG. 3B, the connection part 32202 has three concave parts 32204 between two protrusion parts 32200. The opening directions of the concave parts 32204 could respectively point to the keycap 20 or the base plate 24 (as shown in FIG. 2). Thus, deformation spaces are not only formed on the first surface 32206 of the connection part 32202, but also formed on the second surface 32208. If a corner of the third end 3200 sustains an exterior force (the force direction is shown as the curve with the arrow illustrated in FIG. 3B), the deformation of the third end 3200 can be compensated by a concave space surrounded by the concave part 32204 on the first surface 32206 or the second surface 32208. Thereby, the concave part 32204 increases the deformation limit and the flexibility of the connection part 32202.

Figure 3C:
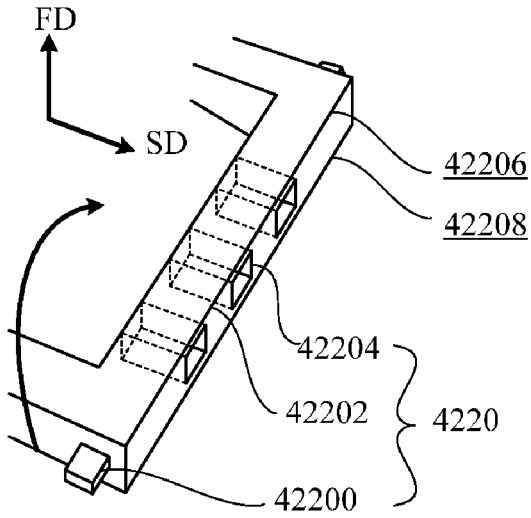
FIG. 3C illustrates a third end according to a third embodiment.

Please refer to FIG. 3C. FIG. 3C illustrates a third end 4220 according to a third embodiment. As illustrated in FIG. 3C, the connection part 42202 has three through holes 42204 between two protrusion parts 42200. The connection part 42202 thereon defines a first direction FD and a second direction SD perpendicular to the first direction FD. The through holes 42204 penetrate the connection part 42202 along the second direction SD. Please refer to FIG. 2. When the second brace 222 substantially lies on the base plate 24, the first direction FD points to the keycap 20. If a corner of the third end 4220 sustains an exterior force (the force direction is shown as the curve with an arrow illustrated in FIG. 3C), the first surface 42206 of the connection part 42202 is in-curved, and the second surface 42208 is ex-curved. The through holes 42204 provide the deformation and bending spaces. Thereby, the through holes 42204 increase the deformation limit of the connection part 4220.

Additionally, as illustrated in FIG. 3A, the connection part 22202 thereon defines a direction passing through the protrusion parts 22200; the concave part 22204 has a cross-section extending along the defined direction and being a U-shape. The cross-section perpendicular to the defined direction consecutively varies along the defined direction. Definitely, the cross-section of the invention is not limited to a U-shape. The cross-section could be an upside-down U-shape (as shown in FIG. 3B), a square-shape (as shown in FIG. 3C), an O-shape or a V-shape. If the cross-section is a smooth shape such as a U-shape or an O-shape, the stress could be distributed more uniformly over the connection part.

Figure 4:
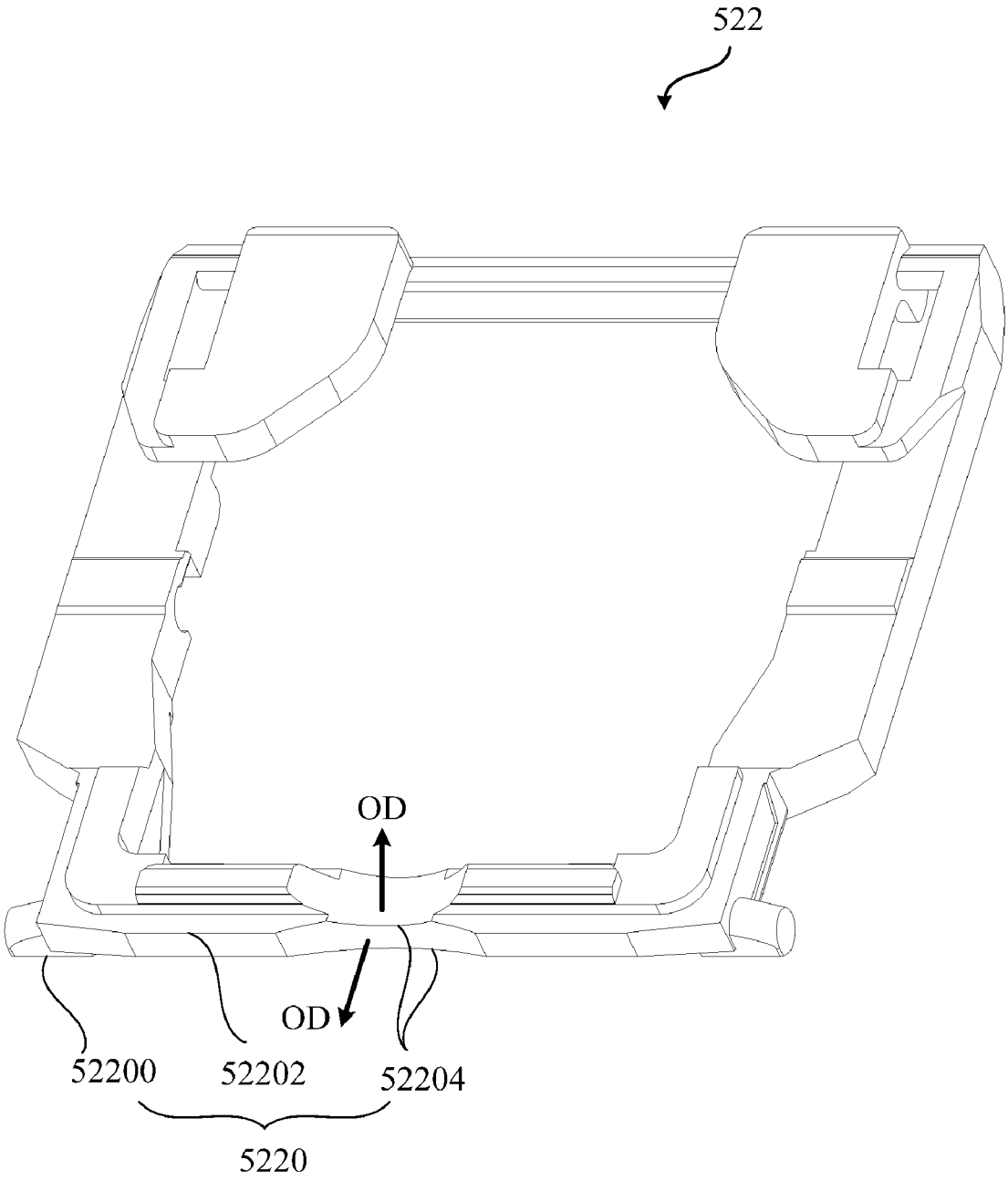
FIG. 4 illustrates a second brace according to a fourth embodiment.

Please refer to FIG. 4. FIG. 4 illustrates a second brace 522 according to a fourth embodiment. As illustrated in FIG. 4, both concave parts 52204 thereon define opening directions OD. When the second brace 522 substantially lies on the base plate 24 (as shown in FIG. 2), one of the opening directions OD is perpendicular to the base plate 24, and the other is parallel to the base plate 24. The different opening directions OD respectively correspond to different force directions. Therefore, the connection part 52202 has a larger deformation limit under different force with different direction. Furthermore, as illustrated in FIG. 4, the protrusion parts 52200 of the third end 5220 have leading corners, and the leading corners could help the protrusion parts 52200 of the third end 5220 to be easily detached from the keycap 20 (as shown in FIG. 2). Namely, the keycap 20 can be more easily removed from the key structure 2.

Compared to the prior art, the key structure of the present invention has concave parts or through holes, so the cross-sectional area of the connection part is decreased and deformation limit of the connection part is increased, meanwhile the connection part still maintains its strength. When the keycap needs to be separated from the support member, the third end of the second brace sustains a pulling force. Because the connection part of the third end can have a larger deformation to absorb the pulling force, the protrusion parts on both sides of the connection part are more difficultly damaged, alternatively, the key structure is durable. Furthermore, the concave parts and the through holes are designed for varying the cross-section of the connection part continuously to avoid stress concentration, such that the connection part will not be easily broken.

Although the present invention has been illustrated and described with reference to the preferred embodiment thereof, it should be understood that it is in no way limited to the details of such embodiment but is capable of numerous modifications within the scope of the appended claims.

What is claimed is:

1. A key structure comprising:

a keycap, comprising a first engagement part and a first slide part;

a base plate, comprising a second engagement part and a second slide part; and a support member engaging with the keycap and the base plate, the support member comprising a first brace and a second brace, the first brace crisscross engaging with the second brace, the first brace comprising a first end and a second end, the second brace comprising a third end and a fourth end, the first end engaging with the first engagement part, the second end sliding along the second slide part, the third end sliding along the first slide part, and the fourth end engaging with the second engagement part;

wherein the third end comprises a connection part, and the connection part comprises at least one concave part or at least one hole, the third end comprises two protrusion parts protruding from two sides of the connection part and sliding along the first slide part, the connection part thereon defines a direction passing through the protrusion parts, the concave part has a cross-section extending along the defined direction and being a U-shape or a V-shape.

2. The key structure of claim 1, wherein the connection part thereon defines a direction passing through the protrusion parts; the connection part has a cross-section perpendicular to the defined direction and consecutively varying along the defined direction.

3. The key structure of claim 1, wherein the concave part thereon defines an opening direction, when the second brace substantially lies on the base plate, the opening direction points to the keycap or the base plate.

4. The key structure of claim 1, wherein the concave part thereon defines an opening direction, when the second brace substantially lies on the base plate, the opening direction is parallel to the base plate.

5. The key structure of claim 1, wherein the connection part of the third end thereon defines a first direction and a second direction perpendicular to the first direction, the hole penetrates the connection part along the second direction; when the second brace substantially lies on the base plate, the first direction points to the keycap.

6. A key structure, comprising:

a keycap, comprising a first engagement part and a first slide part;

a base plate, comprising a second engagement part and a second slide part; and a support member engaging with the keycap and the base plate, the support member comprising a first brace and a second brace, the first brace crisscross engaging with the second brace, the first brace comprising a first end and a second end, the second brace comprising a third end and a fourth end, the first end engaging with the first engagement part, the second end sliding along the second slide part, the third end sliding along the first slide part, and the fourth end engaging with the second engagement part;

wherein the third end comprises a connection part, and the connection part comprises at least one concave part or at least one hole, the concave part thereon defines an opening direction, when the second brace substantially lies on the base plate, the opening direction points to the keycap or the base plate.

7. The key structure of claim 6, wherein the third end comprises two protrusion parts protruding from two sides of the connection part and sliding along the first slide part.

8. The key structure of claim 7, wherein the connection part thereon defines a direction passing through the protrusion parts; the connection part has a cross-section perpendicular to the defined direction and consecutively varying along the defined direction.

9. The key structure of claim 6, wherein the concave part thereon defines an opening direction, when the second brace substantially lies on the base plate, the opening direction is parallel to the base plate.

10. The key structure of claim 6, wherein the connection part of the third end thereon defines a first direction and a second direction perpendicular to the first direction, the hole penetrates the connection part along the second direction; when the second brace substantially lies on the base plate, the first direction points to the keycap.

11. A key structure comprising:

a keycap, comprising a first engagement part and a first slide part;

a base plate, comprising a second engagement part and a second slide part; and a support member engaging with the keycap and the base plate, the support member comprising a first brace and a second brace, the first brace crisscross engaging with the second brace, the first brace comprising a first end and a second end, the second brace comprising a third end and a fourth end, the first end engaging with the first engagement part, the second end sliding along the second slide part, the third end sliding along the first slide part, and the fourth end engaging with the second engagement part;

wherein the third end comprises a connection part, and the connection part comprises at least one concave part or at least one hole, the connection part of the third end thereon defines a first direction and a second direction perpendicular to the first direction, the hole penetrates the connection part along the second direction; when the second brace substantially lies on the base plate, the first direction points to the keycap.

12. The key structure of claim 11, wherein the third end comprises two protrusion parts protruding from two sides of the connection part and sliding along the first slide part.

13. The key structure of claim 12, wherein the connection part thereon defines a direction passing through the protrusion parts; the connection part has a cross-section perpendicular to the defined direction and consecutively varying along the defined direction.

14. The key structure of claim 11, wherein the concave part thereon defines an opening direction, when the second brace substantially lies on the base plate, the opening direction is parallel to the base plate.

* * * * *